US010337678B2

(12) United States Patent
Liu

(10) Patent No.: US 10,337,678 B2
(45) Date of Patent: Jul. 2, 2019

(54) PORTABLE LIGHT SOURCE MODULE WITH SPRING ELECTRODES

(71) Applicant: GUANGDONG JETFAST PORTABLE LIGHTING CO., LTD., Zhongshan (CN)

(72) Inventor: Yun-Zhao Liu, Guangdong Province (CN)

(73) Assignee: Guangdong Jetfast Portable Lighting Co., Ltd., Guangdong (CN)

( * ) Notice: Subject to any disclaimer, the term of this patent is extended or adjusted under 35 U.S.C. 154(b) by 120 days.

(21) Appl. No.: 15/426,308

(22) Filed: Feb. 7, 2017

(65) Prior Publication Data

US 2018/0224076 A1 Aug. 9, 2018

(51) Int. Cl.

| | |
|---|---|
| ***F21L 4/00*** | (2006.01) |
| ***F21V 29/70*** | (2015.01) |
| *F21V 23/06* | (2006.01) |
| *F21V 29/89* | (2015.01) |
| *F21K 9/90* | (2016.01) |

(Continued)

(52) U.S. Cl.

CPC ..... *F21L 4/005* (2013.01); *F21V 29/70* (2015.01); *F21K 9/20* (2016.08); *F21K 9/90* (2013.01); *F21V 23/06* (2013.01); *F21V 29/89* (2015.01); *F21Y 2101/00* (2013.01)

(58) Field of Classification Search

CPC ..... F21L 4/005; F21V 5/006; F21V 7/0075; F21V 9/00; F21V 9/083; F21V 17/12; F21V 17/16; F21V 21/145; F21V 29/70

See application file for complete search history.

(56) References Cited

U.S. PATENT DOCUMENTS 5,959,301 A * 9/1999 Warashina ..... H01J 47/02 250/372
2006/0146526 A1* 7/2006 Shiau ..... F21L 4/027 362/205

(Continued)

FOREIGN PATENT DOCUMENTS

JP WO 2008026627 A1 * 3/2008 ..... B62J 6/02

OTHER PUBLICATIONS

Kurihara, Portable electric light for bicycle, Mar. 6, 2008, Patent pub WO2008026627A1; Google Patents, https://patents.google.com/patent/WO2008026627A1/en.*

*Primary Examiner* — Anh T Mai
*Assistant Examiner* — Michael Chiang
(74) *Attorney, Agent, or Firm* — Rosenberg, Klein & Lee

(57) ABSTRACT

A light source module comprises a substrate at an inner side of a fixing plate, a heat dissipation plate at an inner side of the substrate, a fixing base at an inner side of the heat dissipation plate, a positive and a negative electrode elastic element. The substrate is connected with an illuminate element and formed with a positive and a negative electrode connecting portion for respectively connecting to the positive and negative electrodes of the illuminate element. The positive and negative electrode elastic elements are sleeved at the fixing base and respectively formed with a positive and a negative electrode pin to connect to the positive and negative electrode connecting portions. Accordingly, assembly is easier and more convenient, bad connection or short circuit does not occur, and inner resistance and the power consumption are decreased.

7 Claims, 4 Drawing Sheets

(51) Int. Cl.
*F21Y 101/00* (2016.01)
*F21K 9/20* (2016.01)

(56) References Cited

U.S. PATENT DOCUMENTS

2009/0257223 A1* 10/2009 Liu ..... F21L 4/085
362/206
2011/0304269 A1* 12/2011 Wang ..... F21K 9/00
315/113
2014/0355269 A1* 12/2014 Ohno ..... F21V 17/16
362/269
2015/0085503 A1* 3/2015 Na ..... F21V 23/06
362/373
2016/0161069 A1* 6/2016 Lam ..... F21L 4/027
362/205

* cited by examiner

PORTABLE LIGHT SOURCE MODULE WITH SPRING ELECTRODES

BACKGROUND OF THE INVENTION

Field of the Invention

The present invention relates to a light source module. More particularly, a light source module is easier and more convenient to assemble, bad connection or short circuit is prevented, and inner resistance and power consumption are decreased. Moreover, the material and the performance choice are more flexible and convenient, further decreasing the manufacture cost and increasing the utility.

Description of Related Art

The flashlight is a common illuminating tool in peoples' daily lives for lighting a place which is narrow and which has poor visibility or is dark. It is convenient for people looking for items, walking, exercising, or doing anything. Accordingly, the flashlight is one of the necessary items in peoples' daily lives.

The present common structure of the flashlight comprises a shell and a lampshade base. A light source module is set in front of the shell and is covered by the lampshade base, and the lampshade base and the shell are secured by screws. A battery is put in the shell for providing the light source module electric energy to illuminate. The positive electrode of the battery is conducted with the positive electrode of the light source module, and a switch is set in the lateral side of the shell, making the switch conducting with the negative electrode of the battery. When the switch is pushed, the switch is contacted to the reflector lamp cup of the lampshade base, which lampshade base is conducted to the negative electrode of the light source module, making the electric energy conduct in a loop. Therefore, the illuminating function of the light source module is opened or closed via the control of the switch.

However, even though the foregoing flashlight achieves the illuminating function by providing the necessary electric energy to the light source module, the following disadvantages occur in actual use.

1. In the foregoing flashlight structure, the reflector lamp cup of the lampshade base is conducted to the negative electrode of the light source module for transmitting power, so the assembly is very inconvenient, and the bad connection or short circuit occurs more easily, resulting that the light source module cannot illuminate; furthermore, it consumes more electric energy due to the larger inner resistance of the reflector lamp cup.

2. In the foregoing flashlight structure, the reflector lamp cup of the lampshade base is conducted to the negative electrode of the light source module to transmit power, so the reflector lamp cup needs to be made of metal material, not only limiting the material choice and the performance of the reflector lamp cup, but also the cost to manufacture is increased.

SUMMARY OF THE INVENTION

Accordingly, the object of the present invention is to provide a light source module, of which assembly is easier and more convenient, bad connection or short circuit is prevented, and the inner resistance and the power consumption are decreased, moreover, the material and the performance choice of the reflector lamp cup is more flexible and convenient, further decreasing the manufacture cost and increasing the utility.

For the above object, a light source module comprises a fixing plate, a substrate, a heat dissipation plate, a fixing base for elastic element, a positive electrode elastic element, and a negative electrode elastic element.

The fixing plate is formed with an aperture in the center.

The substrate is set at an inner side of the fixing plate, connected with an illuminate element corresponding to the aperture of the fixing plate, and formed with a positive electrode connecting portion and a negative electrode connecting portion to respectively electrically connect to a positive electrode and a negative electrode of the illuminate element.

The heat dissipation plate is closely set at an inner side of the substrate and formed with a positive electrode through hole and a negative electrode through hole respectively corresponding to the positive electrode connecting portion and the negative electrode connecting portion.

The fixing base for elastic element is set at an inner side of the heat dissipation plate, having an assembling portion and formed with a positive electrode perforation and a negative electrode perforation respectively corresponding to the positive and the negative electrode through holes of the heat dissipation plate.

The positive electrode elastic element is sleeved inside the assembling portion of the fixing base and formed with a positive electrode pin connected with the positive electrode connecting portion of the substrate by passing through the positive electrode perforation of the fixing base and the positive electrode through hole of the heat dissipation plate.

The negative electrode elastic element is sleeved an outer edge of the assembling portion of the fixing base and formed with a negative electrode pin connected with the negative electrode connecting portion of the substrate by passing through the negative electrode perforation of the fixing base and the negative electrode through hole of the heat dissipation plate.

According to an embodiment of the present invention, the fixing plate is formed of a plastic material.

According to an embodiment of the present invention, the fixing plate comprises a screw hole at an outer edge thereof, and the fixing base for elastic element comprises a screwing hole corresponding to the screw hole of the fixing plate, for fixing a screw in the screw hole and the screwing hole.

According to an embodiment of the present invention, the heat dissipation plate is formed of aluminum.

According to an embodiment of the present invention, the fixing base for elastic element is formed of a plastic material.

According to an embodiment of the present invention, the positive electrode pin of the positive electrode elastic element is welded on the positive electrode connecting portion of the substrate.

According to an embodiment of the present invention, the negative electrode pin of the negative electrode elastic element is welded on the negative electrode connecting portion of the substrate.

DETAILED DESCRIPTION OF THE PREFERRED EMBODIMENT

Figure 1:
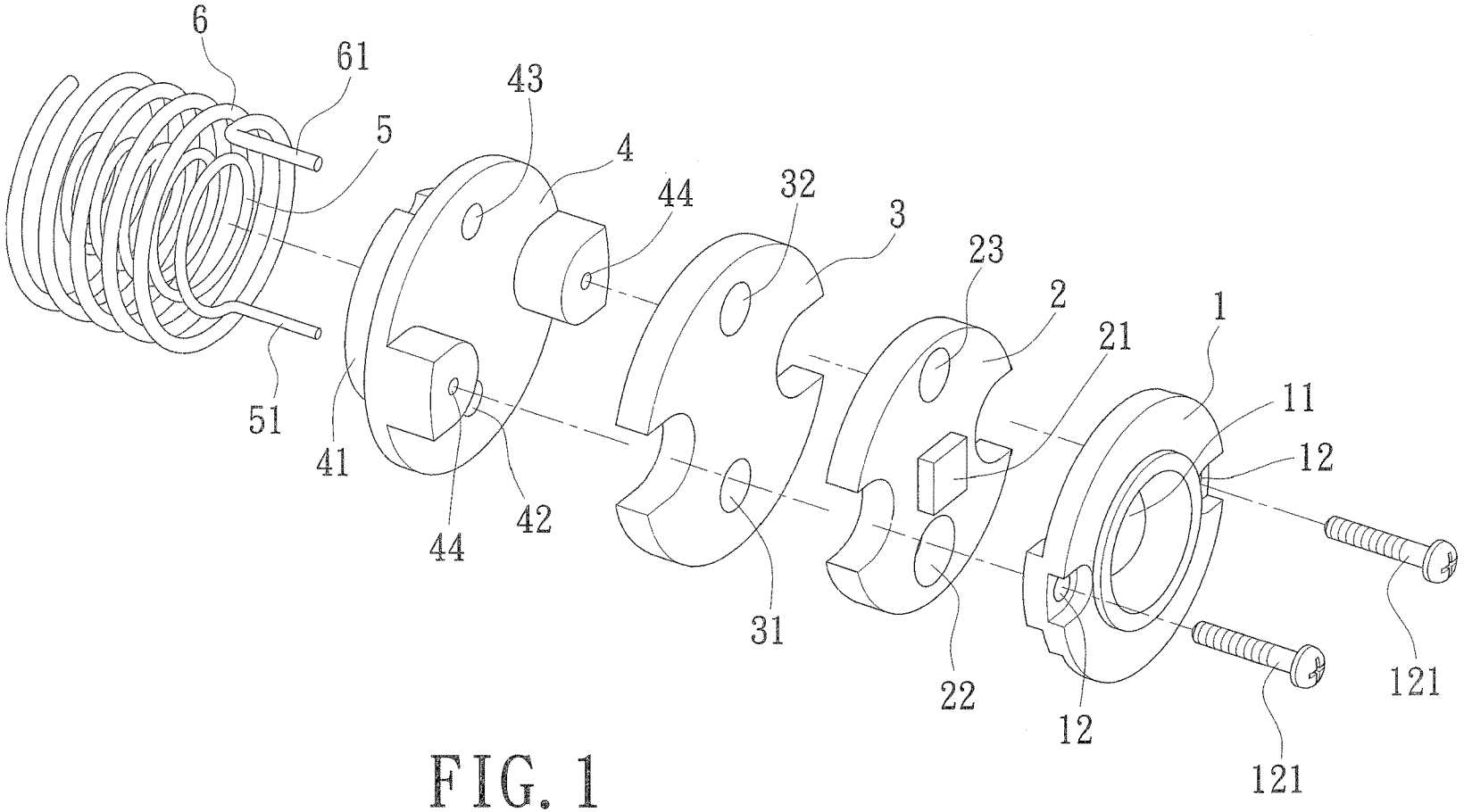
FIG. 1 is a three-dimensional exploded view of a light source module according to an embodiment of the present invention.

Please refer to FIG. 1, which is a three-dimensional exploded view of a light source module according to an embodiment of the present invention. A light source module comprises a fixing plate 1, a substrate 2, a heat dissipation plate 3, a fixing base 4, a positive electrode elastic element 5, and a negative electrode elastic element 6.

The fixing plate 1 is formed of a plastic material and formed with an aperture 11 in the center. A screw hole 12 is formed in an outer edge of the fixing plate 1 for a screw 121 that is being screwed.

The substrate 2 is set at an inner side of the fixing plate 1, connected with an illuminate element 21 corresponding to the aperture 11 of the fixing plate 1, and formed with a positive electrode connecting portion 22 and a negative electrode connecting portion 23 to respectively electrically connect to a positive electrode and a negative electrode of the illuminate element 21.

The heat dissipation plate 3 is formed of aluminum, closely connected to an inner side of the substrate 2, and formed with a positive electrode through hole 31 and a negative electrode through hole 32 respectively corresponding to the positive electrode connecting portion 22 and the negative electrode connecting portion 23 of the substrate 2.

The fixing base 4 is formed of plastic material at an inner side of the heat dissipation plate 3, having an assembling portion 41, and formed with a positive electrode perforation 42 and a negative electrode perforation 43 respectively corresponding to the positive electrode through hole 31 and the negative electrode through hole 32 of the heat dissipation plate 3. Furthermore, the fixing base 4 comprises a screwing hole 44 corresponding to the screw hole 12 of the fixing plate 1 for a screw 121 being screwed.

The positive electrode elastic element 5 is sleeved inside the assembling portion 41 of the fixing base 4 and formed with a positive electrode pin 51 which is passed through the positive electrode perforation 42 of the fixing base 4 and the positive electrode through hole 31 of the heat dissipation plate 3 to weld on the positive electrode connecting portion 22 of the substrate 2.

The negative electrode elastic element 6 is sleeved an outer edge of the assembling portion 41 of the fixing base 4 and formed with a negative electrode pin 61 which is passed through the negative electrode perforation 43 of the fixing base 4 and the negative electrode through hole 32 of the heat dissipation plate 3 to weld on the negative electrode connecting portion 23 of the substrate 2.

Figure 2:
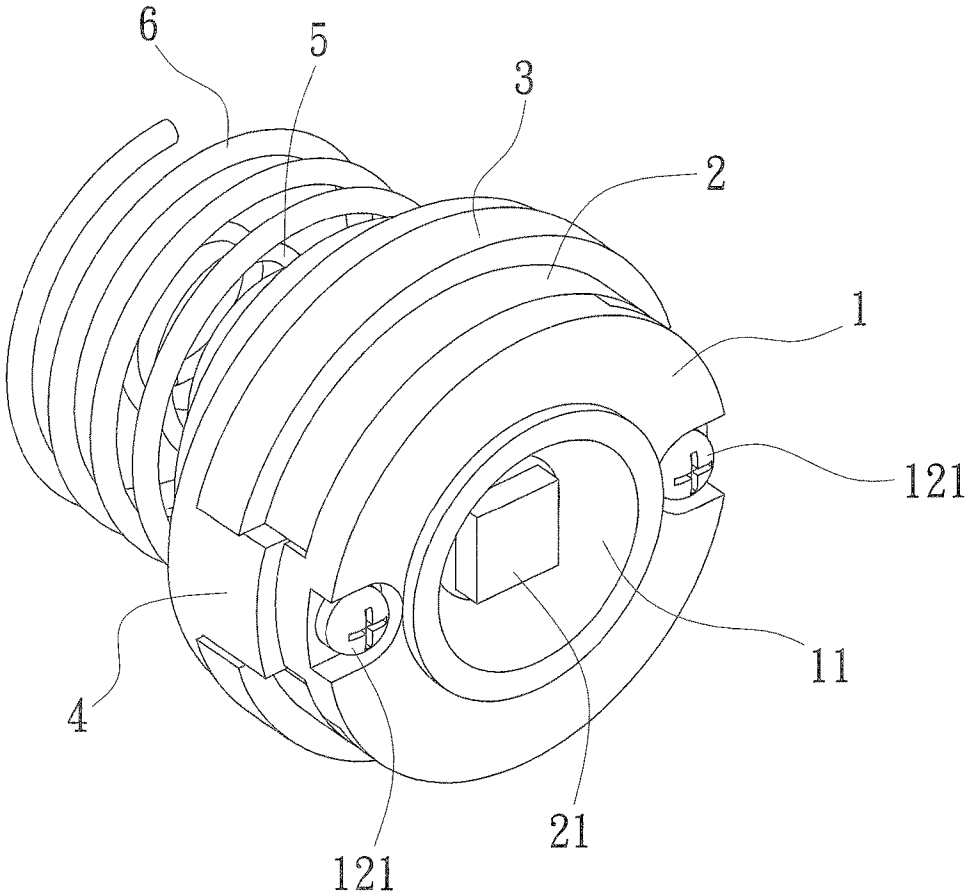
FIG. 2 is a three-dimensional perspective of a light source module according to an embodiment of the present invention.
Figure 3:
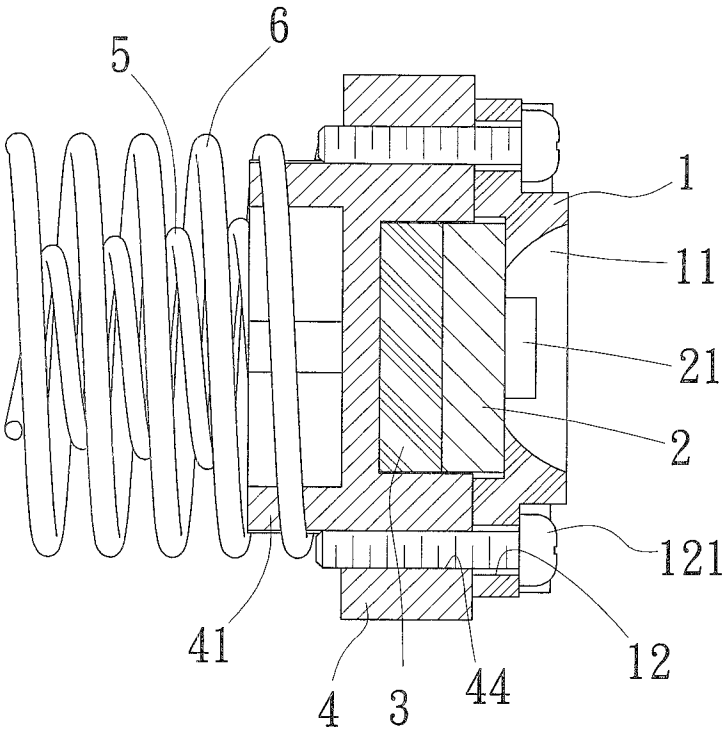
FIG. 3 is a side sectional view of a light source module according to an embodiment of the present invention.

Please refer to FIG. 2 and FIG. 3, which are a three-dimensional perspective and a side sectional view of a light source module according to an embodiment of the present invention. When the light source module of the present invention is assembled, the heat dissipation plate 3 is contacted and connected to the inner side of the substrate 2, and the fixing base 4 is set at the inner side of the heat dissipation plate 3. The positive electrode elastic element 5 is sleeved inside the assembling portion 41 of the fixing base 4, and the positive electrode pin 51 of the positive electrode elastic element 5 is passed through the positive electrode perforation 42 of the fixing base 4 and the positive electrode through hole 31 of the heat dissipation plate 3 to weld on the positive electrode connecting portion 22 of the substrate 2, meanwhile, the negative electrode elastic element 6 is sleeved the outer edge of the assembling portion 41 of the fixing base 4, and the negative electrode pin 61 of the negative electrode elastic element 6 is passed through the negative electrode perforation 43 of the fixing base 4 and the negative electrode through hole 32 of the heat dissipation plate 3 to weld on the negative electrode connecting portion 23 of the substrate 2. Then, the fixing plate 1 is set at the outer side of the substrate 2 and is screwed by the screw 121 passing through the screw hole 12 of the fixing plate 1 and the screwing hole 44 of the fixing base 4, completing the assembly of the light source module.

Figure 4:
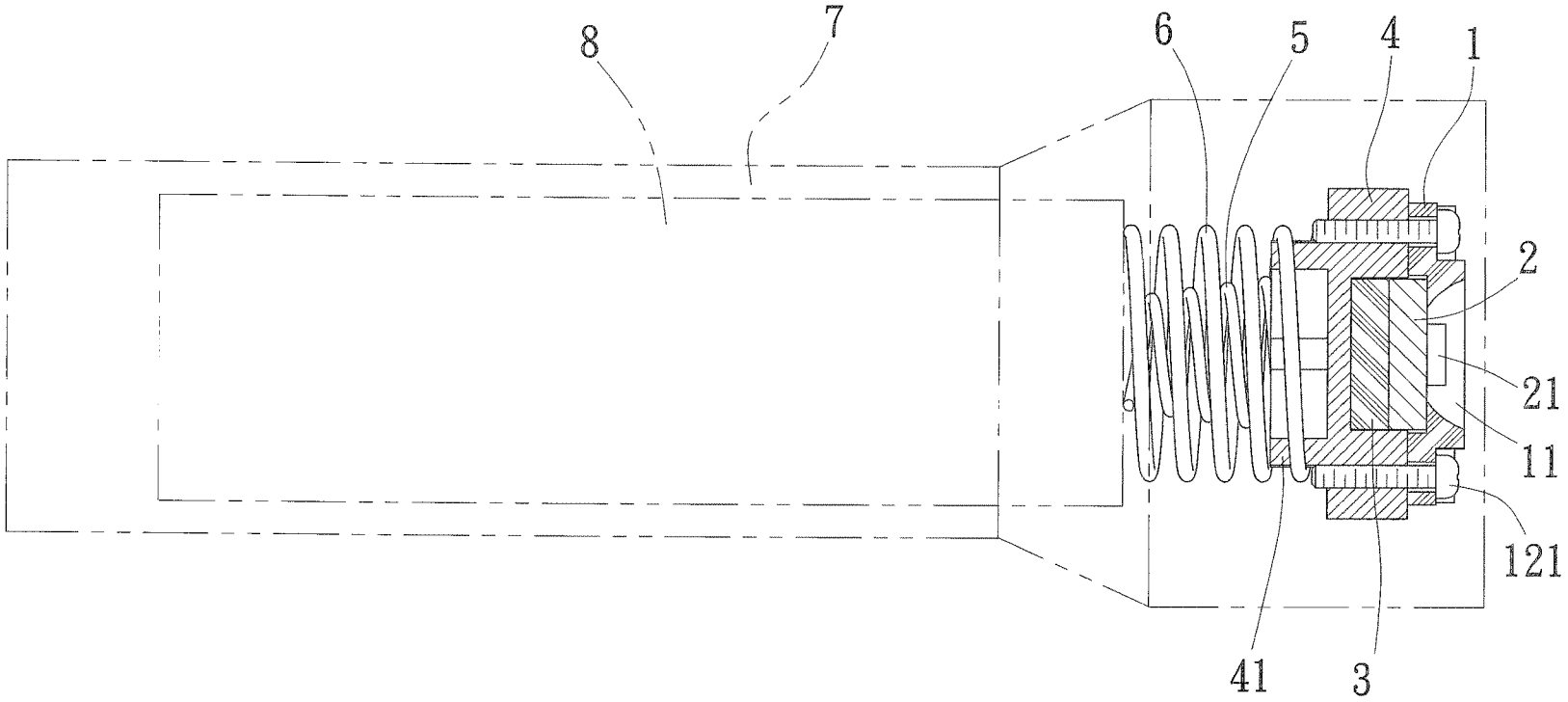
FIG. 4 is a side sectional view of a light source module in use according to an embodiment of the present invention.

Please refer to FIG. 4, which is a side sectional view of a light source module in use according to an embodiment of the present invention. The assembled light source module, comprising the fixing plate 1, the substrate 2, the heat dissipation plate 3, the fixing base 4, the positive electrode elastic element 5, and the negative electrode elastic element 6, is set inside a flashlight shell 7, and a battery 8 is put into the flashlight shell 7, making the positive electrode elastic element 5 contact the positive electrode of the battery 8 and making the negative electrode elastic element 6 contact the negative electrode of the battery 8, thereby lighting the illuminate element 21 of the substrate 2 using energy provided by the battery 8.

According to the above description and embodiments, comparison with the existing structure of the light source module, the light source module of the present invention has the following advantages:

1. In the light source module of the present invention, the positive and negative electrode elastic elements conduct by directly contacting the battery and connecting the positive and negative electrode pins to the positive and negative connecting portions of the substrate, so the assembly of the light source module of the present invention is easier and more convenient, the bad connection or short circuit does not occur, and the inner resistance and the power consumption are decreased.

2. In the light source module of the present invention, the positive and negative electrode elastic elements conduct by directly contacting the battery and connecting the positive and negative electrode pins to the positive and negative connecting portions of the substrate, so power is transmitted without passing the reflector lamp cup, the material and the performance choice of the reflector lamp cup are more flexible and convenient, further decreasing the manufacture cost and increasing the utility.

What is claimed is:

1. A light source module, comprising:

a fixing plate formed with a centrally-disposed aperture;

a substrate set at an inner side of the fixing plate, an illuminate element disposed on the substrate at a position corresponding to the aperture of the fixing plate, and the substrate being formed with a positive electrode connecting portion and a negative electrode connecting portion respectively coupled electrically to a positive electrode and a negative electrode of the illuminate element;

a heat dissipation plate set at an inner side of the substrate and formed with a positive electrode through hole and a negative electrode through hole respectively corresponding in position to the positive electrode connecting portion and the negative electrode connecting portion of the substrate;

a fixing base set at an inner side of the heat dissipation plate and formed with an assembling portion, the fixing base being formed with a positive electrode perforation and a negative electrode perforation respectively corresponding in position to the positive and the negative electrode through holes of the heat dissipation plate;

a positive electrode elastic element sleeved inside the assembling portion of the fixing base and formed with a positive electrode pin passing through the positive electrode perforation of the fixing base and the positive electrode through hole of the heat dissipation plate for coupling to the positive electrode connecting portion of the substrate; and a negative electrode elastic element sleeved at an outer edge of the assembling portion of the fixing base and formed with a negative electrode pin passing through the negative electrode perforation of the fixing base and the negative electrode through hole of the heat dissipation plate for coupling to the negative electrode connecting portion of the substrate;

wherein the fixing base includes a pair of protruding members formed on a surface thereof to be diametrically spaced from one another, and the heat dissipation plate and the substrate are each formed with a pair of diametrically-opposed edge portions peripherally defining recesses retentively engaged by the protruding members of the fixing base.

2. The light source module according to claim 1, wherein the fixing plate is formed of a plastic material.

3. The light source module according to claim 1, wherein the fixing plate includes at least one screw hole at an outer edge thereof, and at least one of the protruding members of the fixing base includes a screwing hole corresponding in position to the screw hole of the fixing plate, and a screw passing through the screw hole and the screwing hole for coupling the fixing plate to the fixing base.

4. The light source module according to claim 1, wherein the heat dissipation plate is formed of aluminum.

5. The light source module according to claim 1, wherein the fixing base is formed of a plastic material.

6. The light source module according to claim 1, wherein the positive electrode pin of the positive electrode elastic element is welded on the positive electrode connecting portion of the substrate.

7. The light source module according to claim 1, wherein the negative electrode pin of the negative electrode elastic element is welded on the negative electrode connecting portion of the substrate.

* * * * *